US009088072B2

(12) United States Patent
Takaki et al.

(10) Patent No.: US 9,088,072 B2
(45) Date of Patent: Jul. 21, 2015

(54) ANTENNA

(75) Inventors: Yasunori Takaki, Tottori (JP); Akinori Misawa, Tottori (JP)

(73) Assignee: HITACHI METALS, LTD., Tokyo (JP)

( * ) Notice: Subject to any disclaimer, the term of this patent is extended or adjusted under 35 U.S.C. 154(b) by 103 days.

(21) Appl. No.: 13/510,742

(22) PCT Filed: Nov. 19, 2010

(86) PCT No.: PCT/JP2010/070731

§ 371 (c)(1),
(2), (4) Date: May 18, 2012

(87) PCT Pub. No.: WO2011/062274

PCT Pub. Date: May 26, 2011

(65) Prior Publication Data

US 2012/0229345 A1 Sep. 13, 2012

(30) Foreign Application Priority Data

Nov. 20, 2009 (JP) ..... 2009-264621
Feb. 10, 2010 (JP) ..... 2010-027127

(51) Int. Cl.
*H01Q 1/38* (2006.01)
*H01Q 9/42* (2006.01)
(Continued)

(52) U.S. Cl.
CPC ..... *H01Q 9/42* (2013.01); *H01Q 1/2291* (2013.01); *H01Q 1/243* (2013.01); *H01Q 1/38* (2013.01); *H01Q 1/40* (2013.01); *H01Q 5/385* (2013.01); *H01Q 5/40* (2013.01); *H01Q 7/00* (2013.01)

(58) Field of Classification Search
CPC ..... H01Q 1/38; H01Q 1/40; H01Q 1/243; H01Q 9/30; H01Q 9/40; H01Q 9/42
USPC ..... 343/700 MS, 702, 873
See application file for complete search history.

(56) References Cited

U.S. PATENT DOCUMENTS 5,748,149 A 5/1998 Kawahata
7,061,434 B2 6/2006 Aoyama et al.
(Continued)

FOREIGN PATENT DOCUMENTS

JP 09-162633 A 6/1997
JP 2000-278028 * 10/2000 ..... H01Q 1/38
(Continued)

OTHER PUBLICATIONS

Communication dated Apr. 30, 2014 from the Japanese Patent Office in counterpart Japanese Application No. 2011-541980.

*Primary Examiner* — Hoang V Nguyen
(74) *Attorney, Agent, or Firm* — Suhgrue Mion, PLLC

(57) ABSTRACT

An antenna comprising a laminate of dielectric ceramic layers each provided with electrode patterns, the laminate comprising a first terminal electrode connected to a feed line and a second terminal electrode for grounding on the lower surface, a radiation electrode on the upper surface or on a layer near the upper surface, and a coupling electrode between the lower surface and the radiation electrode; the coupling electrode being connected to the first terminal electrode through via-holes; the radiation electrode being connected to the second terminal electrode through via-holes; and the coupling electrode being partially opposite to the radiation electrode in a lamination direction to form a capacitance-coupling portion.

8 Claims, 20 Drawing Sheets

(51) Int. Cl.

| | |
|---|---|
| ***H01Q 1/22*** | (2006.01) |
| ***H01Q 1/24*** | (2006.01) |
| ***H01Q 1/40*** | (2006.01) |
| ***H01Q 7/00*** | (2006.01) |
| ***H01Q 5/385*** | (2015.01) |
| ***H01Q 5/40*** | (2015.01) |

(56) References Cited

U.S. PATENT DOCUMENTS

| | | | | |
|---|---|---|---|---|
| 7,109,944 | B2 | 9/2006 | Sato et al. | |
| 7,339,532 | B2 * | 3/2008 | Park et al. | 343/702 |
| 7,777,677 | B2 * | 8/2010 | Bungo et al. | 343/700 MS |
| 7,859,471 | B2 | 12/2010 | Bungo et al. | |
| 8,212,731 | B2 | 7/2012 | Bungo et al. | |
| 2004/0183733 | A1 | 9/2004 | Aoyama et al. | |
| 2005/0162324 | A1 | 7/2005 | Sato et al. | |
| 2007/0285335 | A1 | 12/2007 | Bungo et al. | |
| 2010/0289708 | A1 | 11/2010 | Bungo et al. | |
| 2011/0221642 | A1 | 9/2011 | Bungo et al. | |

FOREIGN PATENT DOCUMENTS

| | | | | |
|---|---|---|---|---|
| JP | 2000-278028 | A | 10/2000 | |
| JP | 2002-158529 | * | 5/2002 | H01Q 1/38 |
| JP | 2002-158529 | A | 5/2002 | |
| JP | 2004304783 | A | 10/2004 | |
| JP | 2005-210680 | A | 8/2005 | |
| JP | 2005210568 | A | 8/2005 | |
| JP | 2005210680 | A | 8/2005 | |

* cited by examiner

ANTENNA

CROSS REFERENCE TO RELATED APPLICATIONS

The application is a National Stage of International Application No. PCT/JP2010/070731 filed on Nov. 19, 2010, which claims priority from Japanese Patent Application Nos. 2009-264621, filed on Nov. 20, 2009 and 2010-027127 filed Feb. 10, 2010, the contents of all of which are incorporated herein by reference in their entirety.

FIELD OF THE INVENTION

The present invention relates to a small antenna having good antenna characteristics and high gain for wireless communications.

BACKGROUND OF THE INVENTION

Various wireless communications systems such as WLAN (wireless local area network), WiMAX (registered trademark), Bluetooth (registered trademark), etc. have recently been rapidly spreading, requiring smaller, thinner and lighter wireless communications apparatuses using them. Required in accordance therewith are small antennas for wireless communications apparatuses usable in various frequency bands.

JP 09-162633 A discloses a capacitance-coupled-feeding, surface-mountable antenna as shown in FIG. 32. This antenna 132 comprises a radiation electrode 122, a feeding terminal 127 and a grounded terminal 128 formed on a substantially rectangular parallelepiped substrate 121 made of a dielectric or magnetic material. The radiation electrode 122 extends in a substantially loop shape on upper and side surfaces of the substrate 121, having an L-shaped end portion on the upper surface of the substrate 121. The feeding terminal 127 formed from the side surface to the upper surface of the substrate 121 has an L-shaped end portion on the upper surface, which is capacitance-coupled to the L-shaped end portion of the radiation electrode 122. The grounded terminal 128 is formed on the side surface of the substrate 121, such that it is connected to another end of the radiation electrode 122. A mounting board 131, on which the antenna 132 is disposed, is provided with a feeding electrode 125 and a ground electrode 126. The antenna 132 is mounted on the mounting board 131, such that the feeding terminal 127 is connected to the feeding electrode 125, and that the grounded terminal 128 is connected to the ground electrode 126. The ground electrode 126 is not formed in a region 124 of the mounting board 131, which is covered with the antenna 132.

In the antenna of JP 09-162633 A having a gap 123 on an outer surface of the substrate 121, the opposing length and gap of the L-shaped end portion of the radiation electrode 122 and the L-shaped end portion of the feeding terminal 127 can be changed by trimming, etc., to adjust coupled capacitance, thereby easily changing the impedance. In a casing of a wireless communications apparatus, however, the coupled capacitance is highly affected by nearby elements, so that the mere adjustment of impedance likely fails to provide the antenna with good antenna characteristics and high gain.

Also, a radiation electrode formed on the substrate has a limited length, likely resulting in an insufficient radiation electrode length as the antenna becomes smaller. Signals should be amplified to make up for small gain due to insufficient line length, needing larger power for amplifiers. As a result, batteries contained in wireless apparatuses become larger, failing to make the wireless apparatuses smaller. Further, the antenna of JP 09-162633 A would not be able to handle different frequency bands (for example, different communications systems) if used alone.

OBJECTS OF THE INVENTION

Accordingly, the first object of the present invention is to provide a small, surface-mountable antenna stably having good antenna characteristics and high gain.

The second object of the present invention is to provide an antenna capable of handling different frequency bands even when used alone.

DISCLOSURE OF THE INVENTION

The antenna of the present invention comprises a laminate of dielectric ceramic layers each provided with electrode patterns, the laminate comprising a first terminal electrode connected to a feed line and a second terminal electrode for grounding on the lower surface, a radiation electrode on the upper surface or on a layer near the upper surface, and a coupling electrode between the lower surface and the radiation electrode; the coupling electrode being connected to the first terminal electrode through via-holes; the radiation electrode being connected to the second terminal electrode through via-holes; and the coupling electrode being partially opposite to the radiation electrode in a lamination direction to form a capacitance-coupling portion. The laminate acts as an antenna even when used alone.

This structure enables the formation of a path from the first terminal electrode to the coupling electrode, the capacitance-coupling portion, and a path from the radiation electrode to the second terminal electrode in the laminate, suppressing interference with other circuit elements, etc., thereby providing an antenna having stable impedance characteristics without lowering radiation efficiency and gain. Also, by changing not only an opposing area between the radiation electrode and the coupling electrode but also the material and thickness of dielectric ceramic layers therebetween, the coupled capacitance of the radiation electrode and the coupling electrode can be adjusted.

Because each dielectric ceramic layer can be formed with a thickness of about several microns to about 300 μm with high precision by a known method such as a doctor blade method, a printing method, etc., it is possible to obtain an antenna having stable impedance characteristics with little variation of the coupled capacitance. Also, because a narrower gap between the radiation electrode and the coupling electrode unlikely provides short-circuiting, the capacitance-coupling portion can be made smaller, thereby providing a smaller laminate.

The radiation electrode may be constituted by pluralities of electrode portions, and an electrode portion opposite to the coupling electrode and other electrode portions may be formed on different layers. For example, the radiation electrode is constituted by a main radiation electrode portion, and a sub-radiation electrode portion formed on a different layer from that of the main radiation electrode and opposing the coupling electrode in a lamination direction. The main radiation electrode portion and the sub-radiation electrode portion are connected for direct current through via-holes, and the capacitance-coupling portion is constituted by the sub-radiation electrode portion and the coupling electrode.

In a preferred embodiment of the present invention, the laminate comprises a third terminal electrode for grounding on the lower surface, the third terminal electrode being not connected to the radiation electrode and the coupling electrode, but overlapping the radiation electrode in a lamination direction, and forming capacitance with the first terminal electrode. More terminal electrodes provide higher connection strength to the board on which the laminate is mounted. When the third terminal electrode is grounded, the input impedance of the antenna can be adjusted by capacitance formed between the third terminal electrode and the first terminal electrode.

In another preferred embodiment of the present invention, the laminate comprises a third terminal electrode for grounding on the lower surface, the third terminal electrode being not connected to the radiation electrode and the coupling electrode, but overlapping the radiation electrode in a lamination direction, and connected to the first terminal electrode. Connection to the first terminal electrode can be made via a connecting electrode formed on the laminate or the board. With this structure, an inverted-F antenna with a grounded radiation electrode can be obtained, achieving easier control of the input impedance.

The laminate may comprise a fifth terminal electrode in a substantially center portion of the lower surface. The fifth terminal electrode preferably does not overlap the radiation electrode and the coupling electrode in a lamination direction.

An antenna according to a further preferred embodiment of the present invention comprises a board on which the laminate is mounted, the board being provided with a ground electrode having a first line electrode, and the second terminal electrode being connected to the ground electrode via the first line electrode. The first line electrode acts as an additional radiation electrode, improving the gain. Providing the first line electrode with a reactance element, the phase can be adjusted, and the gain can be increased, for example, when the effective length of the radiation electrode is insufficient to high-frequency signals.

An antenna according to a still further preferred embodiment of the present invention comprises a board on which the laminate is mounted, the board being provided with a ground electrode having first and second line electrodes; the second terminal electrode being connected to the ground electrode via the first line electrode; and the third terminal electrode being connected to the ground electrode via the second line electrode. High-frequency power is supplied to the third terminal electrode via capacitance between the third terminal electrode and the first terminal electrode, and capacitance between the third terminal electrode and the radiation electrode. Using the second line electrode connected to the third terminal electrode as a radiation electrode having a different resonance frequency from that of the radiation electrode, a multi-band antenna usable in pluralities of frequency bands can be obtained. Further, each of the first and second line electrodes is preferably provided with a reactance element to supplement the effective length of the radiation electrode.

BRIEF DESCRIPTION OF THE DRAWINGS

FIG. 12(*b*) is a plan view showing the positional relation between the terminal electrodes of the laminate and the ground electrode and the line electrodes on the board when the laminate is mounted on the board of FIG. 12(*a*).

FIG. 16(*b*) is a plan view showing the positional relation between the terminal electrodes of the laminate and the ground electrode and the line electrodes on the board when the laminate is mounted on the board of FIG. 16(*a*).

FIG. 27(*b*) is a graph showing the VSWR characteristics of the antenna of Example 2.

FIG. 29(*b*) is a graph showing the VSWR characteristics of the antenna of Example 3.

DESCRIPTION OF THE PREFERRED EMBODIMENTS

Figure 1:
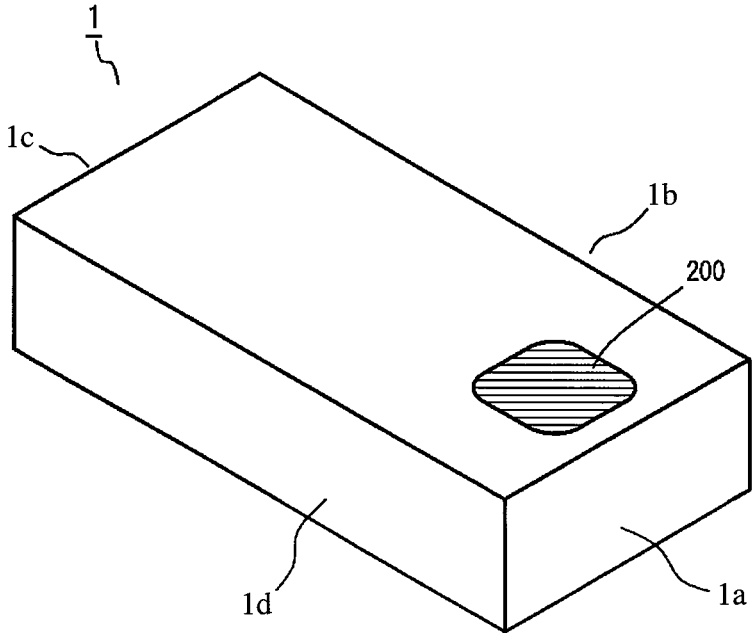
FIG. 1 is a perspective view showing the appearance of one example of the laminates, which constitutes the antenna of the present invention.
Figure 2:
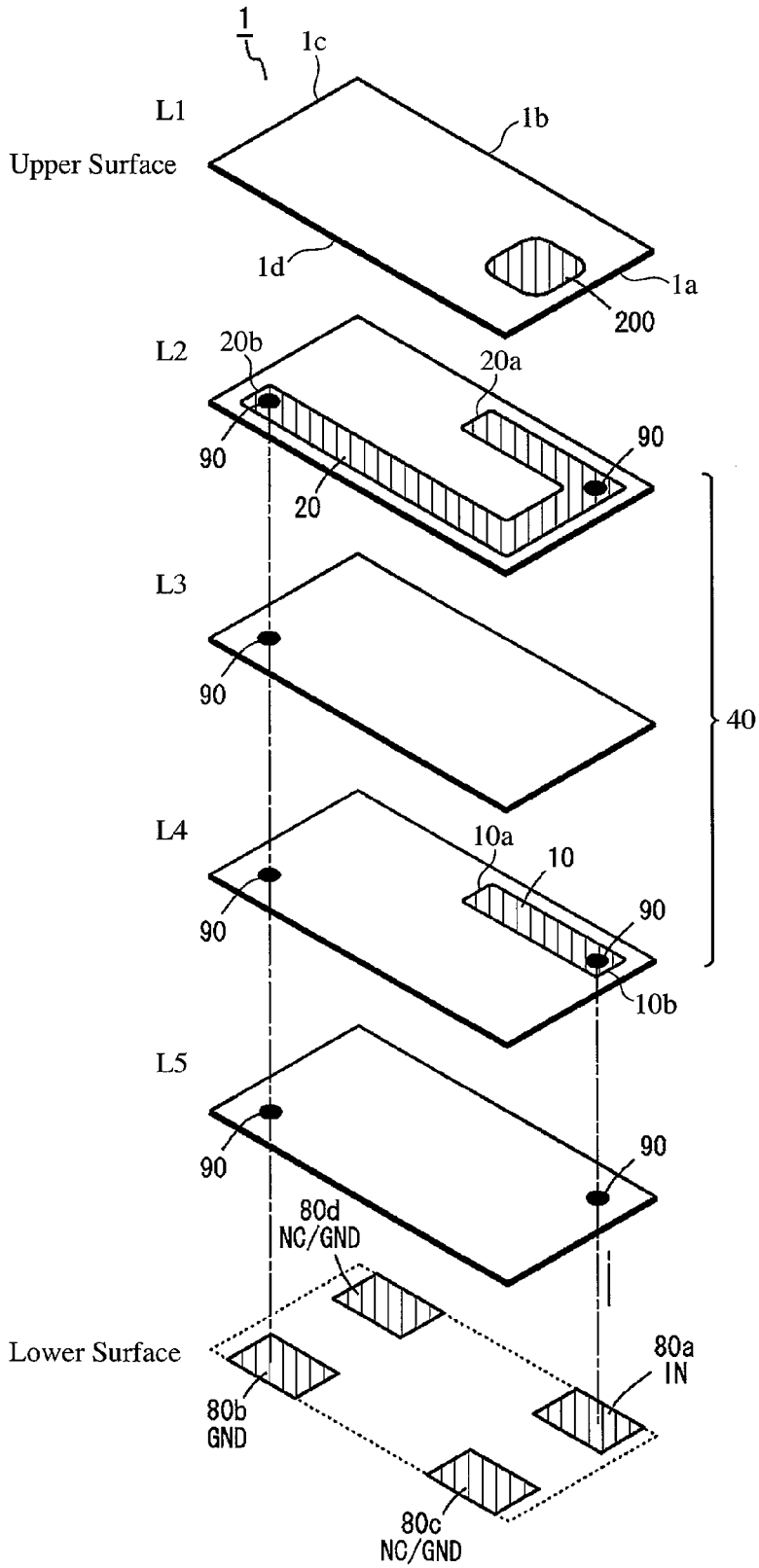
FIG. 2 is an exploded perspective view showing one example of the layer structures of the laminates, which constitutes the antenna of the present invention.
Figure 3:
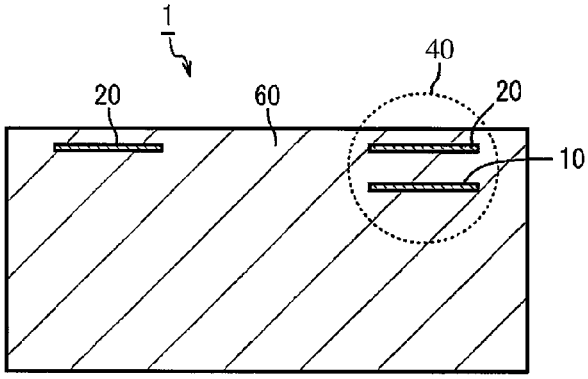
FIG. 3 is a lateral cross-sectional view showing the laminate of FIG. 2.
Figure 4:
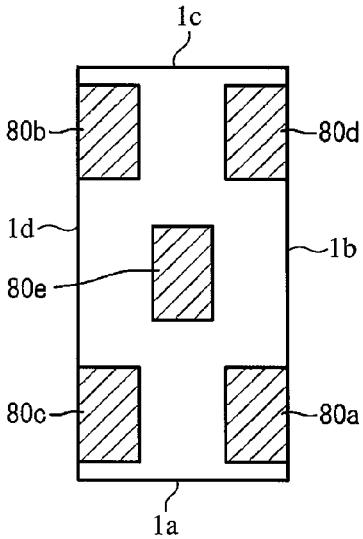
FIG. 4 is a view showing from above another example of the arrangements of terminal electrodes, which is formed on a lower surface of the laminate.

FIG. 1 shows the appearance of a laminate used in the antenna of the present invention, FIG. 2 shows the internal structure of the laminate, FIG. 3 shows the lateral cross section of the laminate 1, and FIG. 4 shows the arrangement of terminal electrodes on a lower surface of the laminate. The laminate 1 has a rectangular parallelepiped shape having an upper surface, a lower surface and four side surfaces (first and second shorter side surfaces 1*a*, 1*c*, and first and second longer side surfaces 1*b*, 1*d*), for example, having an external size of 5 mm or less in length, 5 mm or less in width and 1.5 mm or less in thickness. Formed on the upper surface is a mark 200 made of a colored glass, etc. for indicating a laminate direction, and the mark 200 may be provided with symbols such as numbers, alphabets, etc.

Formed on the lower surface of the laminate 1 are a first terminal electrode 80*a* in contact with the first longer side surface 1*b* near the first shorter side surface 1*a*, a second terminal electrode 80*b* (positioned diagonally to the first terminal electrode 80*a*) in contact with the second longer side surface 1*d* near the second shorter side surface 1*c*, a third terminal electrode 80*c* in contact with the second longer side surface 1*d* near the first shorter side surface 1*a*, and a fourth terminal electrode 80*d* (positioned diagonally to the third terminal electrode 80*c*) in contact with the first longer side surface 1*b* near the second shorter side surface 1*c*. In the example shown in FIG. 4, a fifth terminal electrode 80*e* is formed in a substantially center portion of the lower surface of the laminate 1. Because the fourth and fifth terminal electrodes 80*d*, 80*e* are electrodes formed to increase connection strength to the board when mounted thereto, they are not connected to the radiation electrode and the coupling electrode. A larger number of terminal electrodes provide a larger connection area with the board and thus larger connection strength, but the characteristics of the antenna should be taken into consideration. For example, when the fourth and fifth terminal electrodes 80*d*, 80*e* overlap the radiation electrode 20 in a lamination direction, resonance current flowing through the radiation electrode 20 returns through the fourth and fifth terminal electrodes 80*d*, 80*e*, likely deteriorating the characteristics of the antenna. Accordingly, the fourth and fifth terminal electrodes 80*d*, 80*e* are preferably positioned such that they do not overlap the radiation electrode 20 or the coupling electrode in a lamination direction. Though each terminal electrode 80*a*-80*e* is rectangular in the depicted example, it may be in other shapes such as a circle, and all terminal electrodes need not have the same size.

Because the laminate 1 is made of a dielectric ceramic, its corners may be cracked by an external force. When part of the terminal electrodes are lost by the cracking of the corners, the antenna characteristics are deteriorated. Accordingly, the terminal electrodes are prevented from being lost by notches formed at their corners, or by the setback of the terminal electrodes from a periphery of the lower surface of the laminate 1.

Formed in the laminate 1 are a coupling electrode 10 connected to the first terminal electrode 80*a*, and a radiation electrode 20 partially opposite to the coupling electrode 10 via a dielectric layer for capacitance coupling. The radiation electrode 20 has one end 20*a* as an open end and the other end 20*b* connected to the second terminal electrode 80*b*. The connection of the first terminal electrode 80*a* to the coupling electrode 10 and the connection of the radiation electrode 20 to the second terminal electrode 80*b* are conducted through via-holes 90 formed in the laminate 1. The laminate 1 comprises other layers than layers L1-L5, though not depicted.

As shown in FIG. 2, the coupling electrode 10 is formed by a strip electrode pattern of 0.1-1 mm in width extending from near the first shorter side surface 1*a* along the first longer side surface 1*b* on a layer L4, and the radiation electrode 20 is formed by a J-shaped strip electrode pattern of 0.1-1 mm in width extending from near the second shorter side surface 1*c* along the second longer side surface 1*d*, the first shorter side surface 1*a* and the first longer side surface 1*b* on a layer L2. The line length (from one end 20*a* to the other end 20*b*) of the radiation electrode 20 is substantially ¼ of the wavelength λ of an operation frequency. The term "line length" used herein means an effective length including a wavelength-reducing effect by a dielectric body, etc. Because of the J shape, the radiation electrode 20 has a necessary line length in a limited area. If the radiation electrode 20 were meandering, opposite-phase current would have large influence, resulting in a low gain. Therefore, a portion of the radiation electrode 20 along the second longer side surface 1*d*, which contributes mainly to receiving and radiating electromagnetic waves, is preferably not bent.

Figure 6:
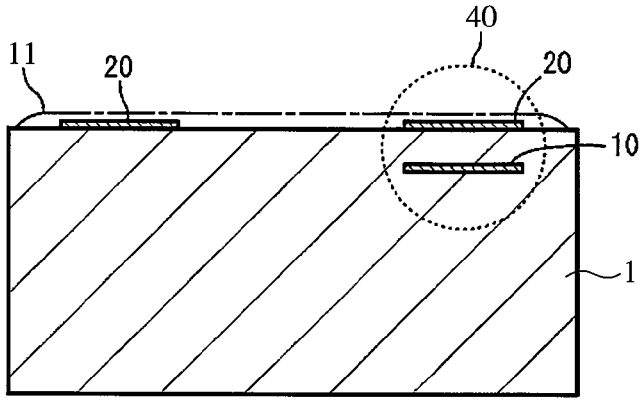
FIG. 6 is a lateral cross-sectional view showing another example of the laminates of FIG. 2.

The coupling electrode 10 partially overlaps the radiation electrode 20 in a lamination direction. The coupling electrode 10 has an open end 10*a* on the side of the second shorter side surface 1*c*, and an end portion 10*b* on the side of the first shorter side surface 1*a*, which is connected to the first terminal electrode 80*a*. When the radiation electrode 20 is formed on a layer L1 (an upper surface of the laminate 1) in place of the layer L2, an upper surface of the laminate 1 is preferably coated with a protective layer 11 of an overcoat glass as shown in FIG. 6.

Coupled capacitance is adjusted by the opposing area and gap of the coupling electrode 10 and the radiation electrode 20 in a lamination direction. A gap between the coupling electrode 10 and the radiation electrode 20 is preferably 300 μm or less, though variable depending on the capacitance needed. When this gap exceeds 300 μm, the coupling electrode 10 should be made larger to secure capacitance, resulting in a larger laminate 1.

Figure 7:
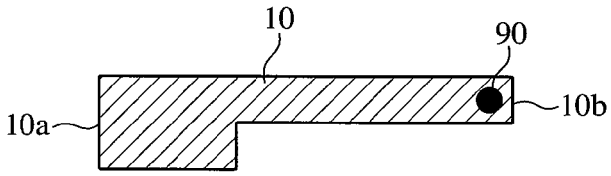
FIG. 7 is a plan view showing another example of the coupling electrodes.
Figure 8:
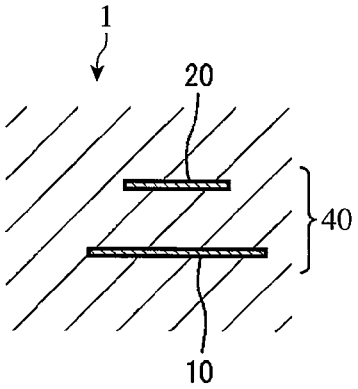
FIG. 8 is a partial, enlarged cross-sectional view showing a capacitance-coupling portion in the laminate.

Though the coupling electrode 10 may be a simple rectangular strip, it may have a wider portion (for example, an open end portion 10*a*) as shown in FIG. 7. Also, as shown in FIG. 8, one electrode (for example, coupling electrode 10) may be wider than the other electrode (for example, radiation electrode 20). With the coupling electrode 10 wider than the radiation electrode 20, capacitance variations due to lateral displacement in the lamination can be suppressed. Part of the coupling electrode 10 or the radiation electrode 20 may be exposed to the first longer side surface 1*b* of the laminate 1. In this case, there is little interference with other devices, and capacitance can be easily adjusted by trimming an electrode appearing on a side surface.

Figure 9:
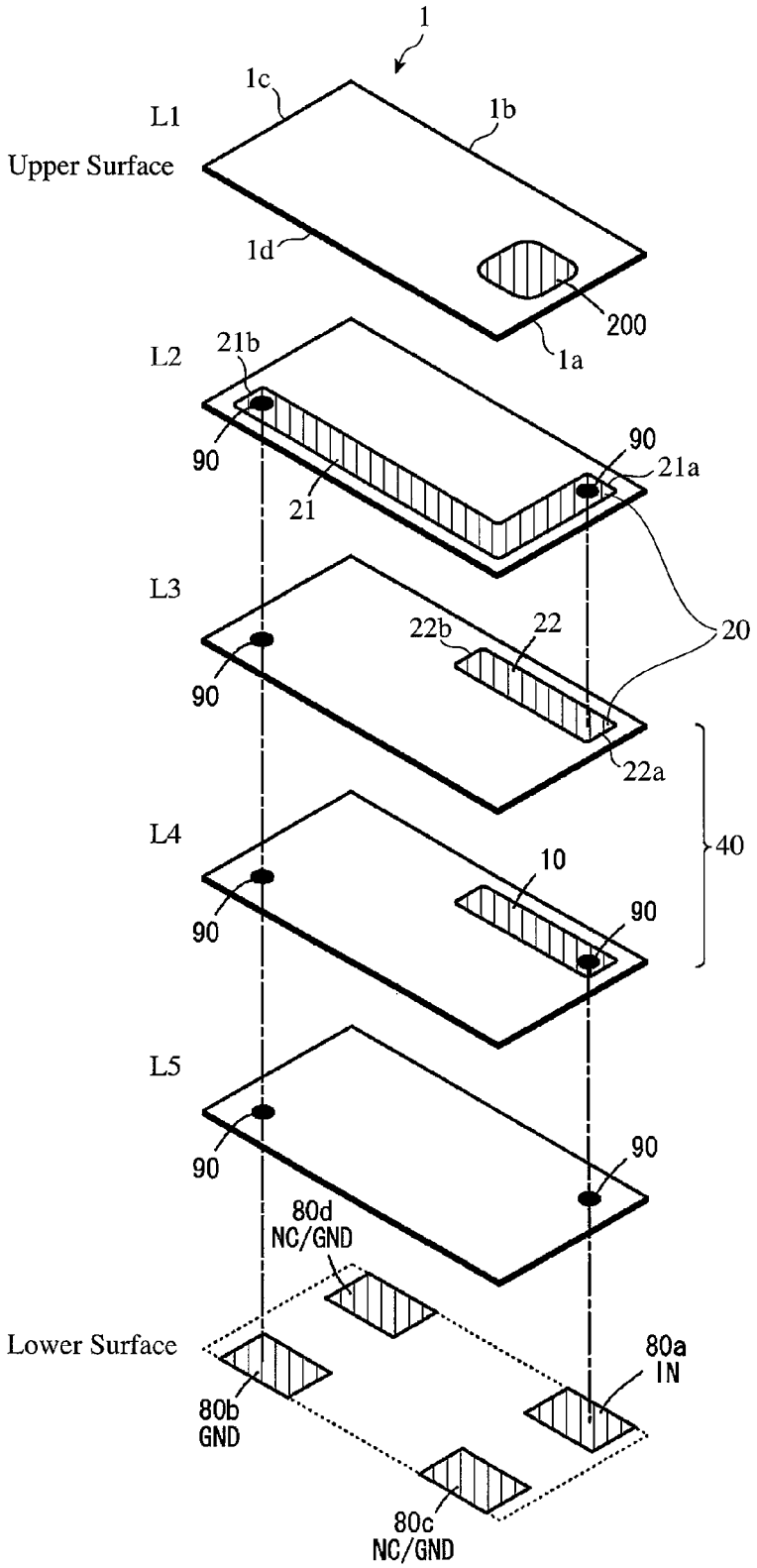
FIG. 9 is an exploded perspective view showing another example of the layer structures of the laminates, which constitutes the antenna of the present invention.
Figure 10:
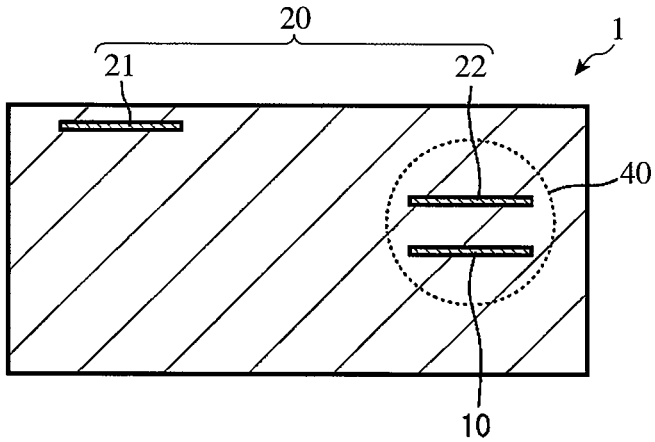
FIG. 10 is a lateral cross-sectional view showing the laminate of FIG. 9.

Though the radiation electrode 20 is formed by an integral electrode pattern in the example shown in FIG. 2, it may be constituted by pluralities of electrode patterns. FIG. 9 shows an example in which a radiation electrode 20 is constituted by a main radiation electrode portion 21 and a sub-radiation electrode portion 22. Because the laminate 1 of FIG. 9 has the same basic structure as shown in FIG. 2, explanation will be omitted on the same portions. A coupling electrode 10 beside a first longer side surface 1*b* on a dielectric layer L4 is formed by an I-shaped strip electrode pattern of 0.1-1 mm in width, the sub-radiation electrode portion 22 on a dielectric layer L3 is formed by an I-shaped strip electrode pattern of 0.1-1 mm in width positioned beside a first longer side surface 1*b*, and the main radiation electrode portion 21 on a dielectric layer L2 is formed by an L-shaped strip electrode pattern of 0.1-1 mm in width extending along a second longer side surface 1*d* and a first shorter side surface 1*a*. As shown in FIG. 10, the coupling electrode 10 on the dielectric layer L4 is opposite to the sub-radiation electrode portion 22 on the dielectric layer L3 in a lamination direction, constituting a capacitance-coupling portion 40 via the dielectric layer L3. An open end 22*b* of the sub-radiation electrode portion 22 is on the side of the second shorter side surface 1*c*, and an end portion 22*a* of the sub-radiation electrode portion 22 on the side of the first shorter side surface 1*a* is connected to an end portion 21*a* of the main radiation electrode portion 21 on the side of the first longer side surface 1*b* on the dielectric layer L2 through a via-hole 90. An end portion 21*b* of the main radiation electrode portion 21 on the side of the second shorter side surface 1*c* is connected to the second terminal electrode 80*b* through via-holes 90.

Figure 11:
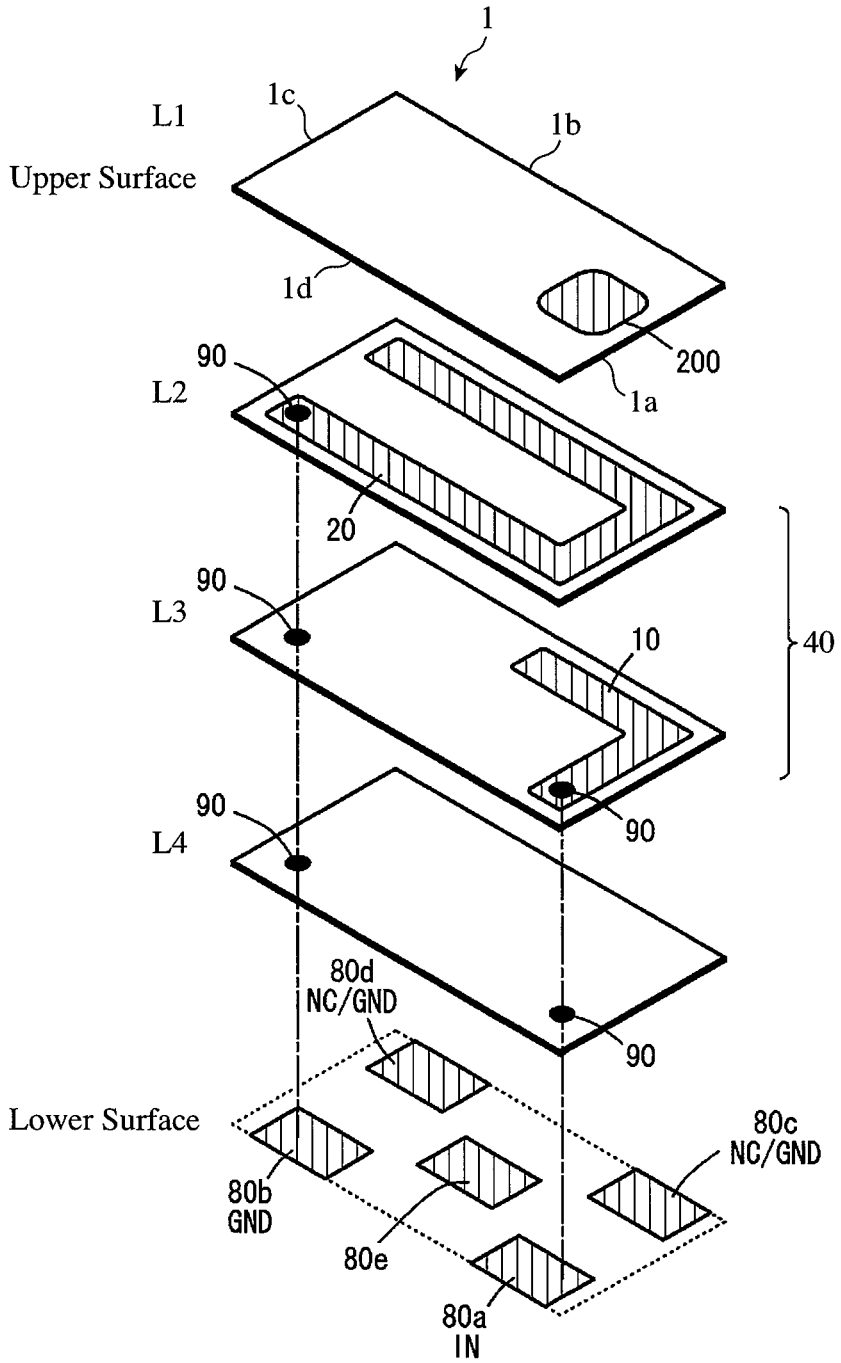
FIG. 11 is an exploded perspective view showing a further example of laminates, which constitutes the antenna of the present invention.

FIG. 11 shows another structure of the laminate. A coupling electrode 10 is formed by an L-shaped strip electrode pattern extending along a first shorter side surface 1*a* and a first longer side surface 1*b*, and a radiation electrode 20 is formed by a U-shaped strip electrode pattern extending along a second longer side surface 1*d*, a first shorter side surface 1*a* and a first longer side surface 1*b*. To keep the laminate small without increasing conduction loss even with a longer radiation electrode 20, a capacitance-coupling portion 40 is preferably located in a region corresponding to an end portion of the radiation electrode 20, though the capacitance-coupling portion 40 may extend along the first shorter side surface 1*a* and the first longer side surface 1*b* as shown in FIG. 11.

Figure 12A:
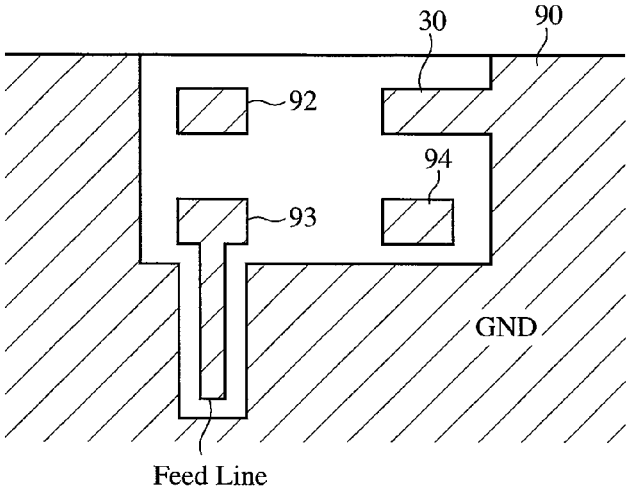
FIG. 12(*a*) is a plan view showing one example of the ground electrode and line electrodes on the board.
Figure 12B:
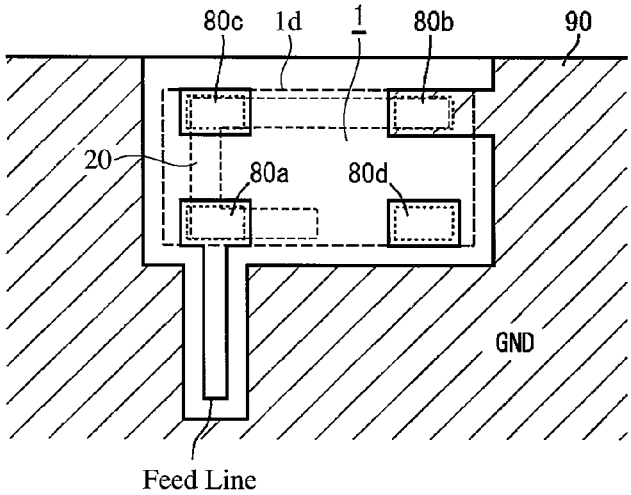
Figure 13:
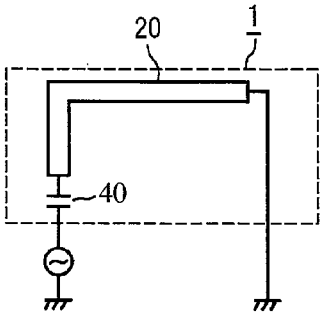
FIG. 13 is a view showing the equivalent circuit of an antenna corresponding to FIG. 12.

FIG. 12(*a*) shows a board 90 on which the laminate 1 is mounted. The board 90 is provided with a ground electrode GND, a line electrode 30 integrally projecting from the ground electrode GND, and electrodes 92-94 each soldered to each terminal electrode. As shown in FIG. 12(*b*), the laminate 1 shown by a broken line is mounted such that its second longer side surface 1*d* faces an edge of the board 90. The second terminal electrode 80*b* connected to one end portion of the radiation electrode 20 is connected to the ground electrode GND via the line electrode 30. As is clear from the equivalent circuit shown in FIG. 13, this antenna is a ¼-wavelength antenna comprising a capacitance-coupling portion 40 on the feed line side, and a radiation electrode 20 having a grounded end. The first and second terminal electrodes 80*a*, 80*b* disposed at diagonally opposing corners of the laminate 1 are connected to the J-shaped radiation electrode 20, and the second longer side surface 1*d* of the laminate 1 faces the edge of the board 90. Accordingly, a side of the radiation electrode 20 on the side of the second longer side surface 1*d* contributing to receiving and radiating electromagnetic waves is distant from the feed line, resulting in excellent antenna characteristics.

Figure 22:
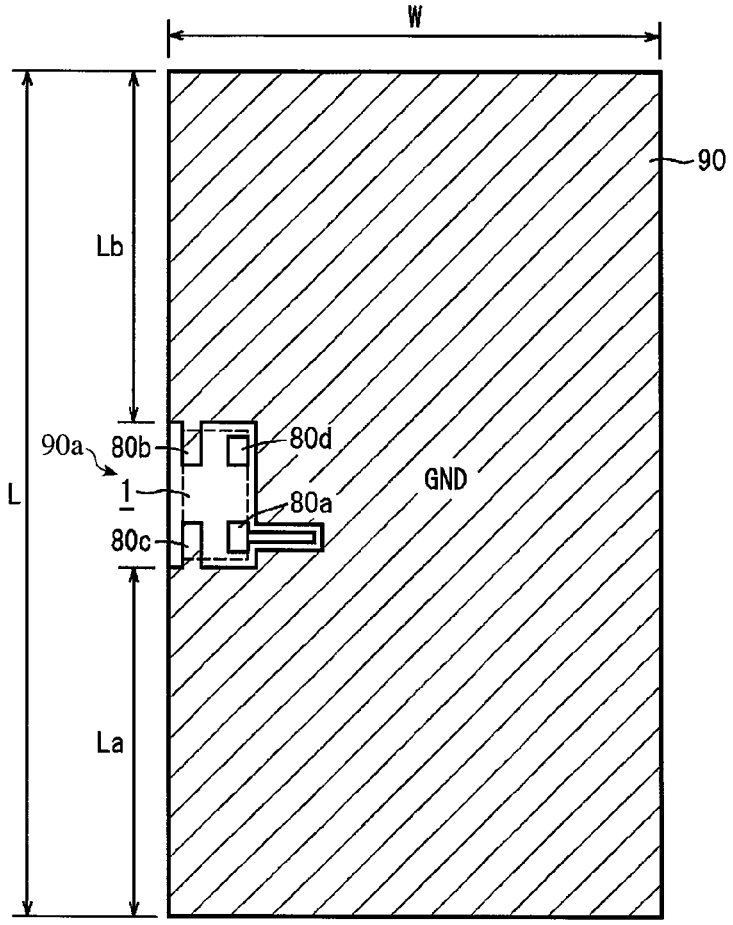
FIG. 22 is a plan view showing a still further example of the terminal electrodes of the laminate and the ground electrode and the line electrodes on the board when the laminate is mounted on the board.

The gain of an antenna with such a structure changes depending on image current flowing through the ground electrode GND. Thus, as shown in FIG. 22, the laminate 1 is preferably mounted on a substantially intermediate portion of a longer side of a ground electrode GND formed on a board 90 having a length L, which is substantially ½ of an operation wavelength λ, of the antenna. When the length L of the board 90 is insufficient, a longer side of the ground electrode GND may be provided with a slit to have a longer apparent edge. As the mounting position of the laminate 1 becomes closer to the intermediate portion from a shorter side of the board 90, the antenna characteristics become higher. A length La from one end of the board 90 to a notch 90*a* of the ground electrode GND is preferably substantially equal to a length Lb from the other end of the board 90 to the notch 90*a* of the ground electrode GND. In this case, too, the longer side of the ground electrode GND may be provided with a slit to adjust its apparent length.

Figure 14:
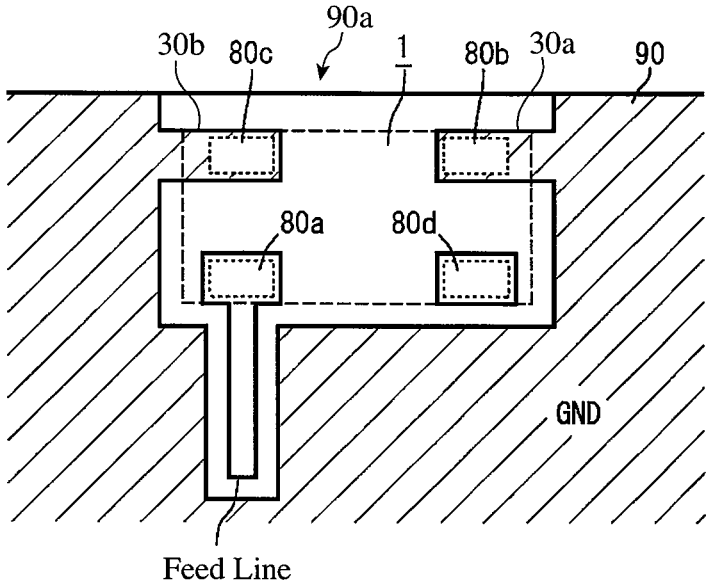
FIG. 14 is a plan view showing another example of the positional relations between the terminal electrodes of the laminate and the ground electrode and the line electrodes on the board when the laminate is mounted on the board.
Figure 15:
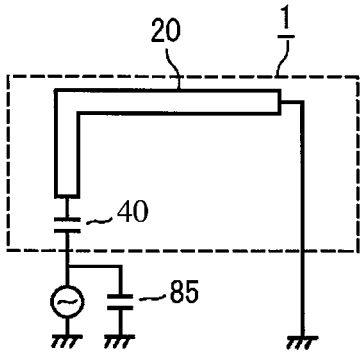
FIG. 15 is a view showing the equivalent circuit of an antenna corresponding to FIG. 14.

FIG. 14 shows another board 90 used in the present invention. In this example, a ground electrode GND on the board 90 has a notch 90*a*, and first and second line electrodes 30*a*, 30*b* project integrally from the ground electrode GND into the notch 90*a*. The first line electrode 30*a* is connected to the second terminal electrode 80*b* of the laminate 1, and the second line electrode 30*b* is connected to the third terminal electrode 80*c* of the laminate 1. With this structure, capacitance is generated between the first terminal electrode 80*a* and the third terminal electrode 80*c*, providing an equivalent circuit shown in FIG. 15. A capacitor 85 between the first terminal electrode 80*a* and the third terminal electrode 80*c* is connected between the capacitance-coupling portion 40 and the feed line. The adjustment of the capacitor 85 controls input impedance.

Figure 16A:
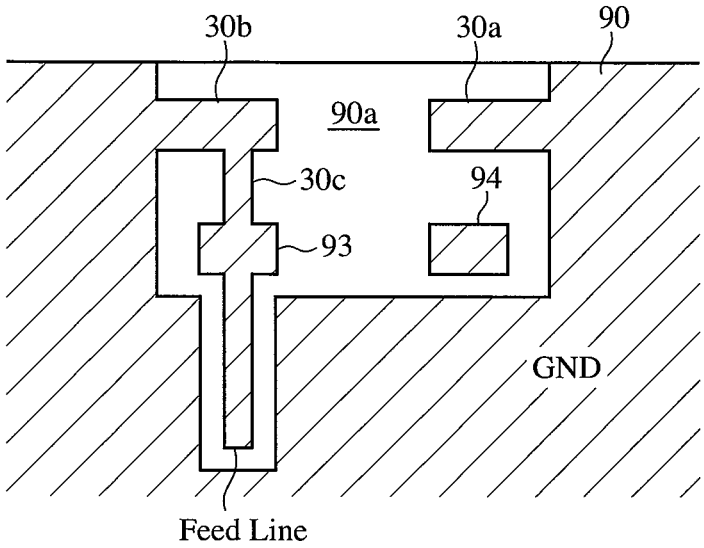
FIG. 16(*a*) is a plan view showing a further example of the ground electrode and the line electrodes on the board.
Figure 16B:
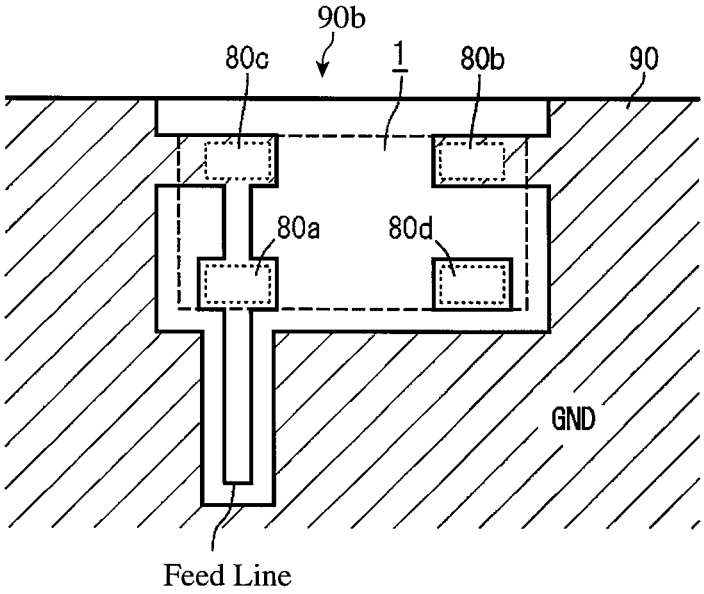
Figure 17:
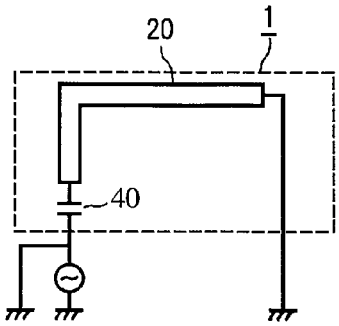
FIG. 17 is a view showing the equivalent circuit of an antenna corresponding to FIG. 16.

FIGS. 16(*a*) and 16(*b*) show a further example of boards used in the present invention. In this example, first and second line electrodes 30*a*, 30*b* project integrally from a ground electrode GND, and a third line electrode 30*c* is formed between the second line electrode 30*b* and an electrode 93. When the laminate 1 is mounted on the board 90 having this structure, the first and third terminal electrodes 80*a*, 80*c* are connected to the ground electrode GND, providing an equivalent circuit shown in FIG. 17. A grounding path is formed between the capacitance-coupling portion 40 and the feed line, providing a structure like an inverted-F antenna with easy control of input impedance.

Figure 18:
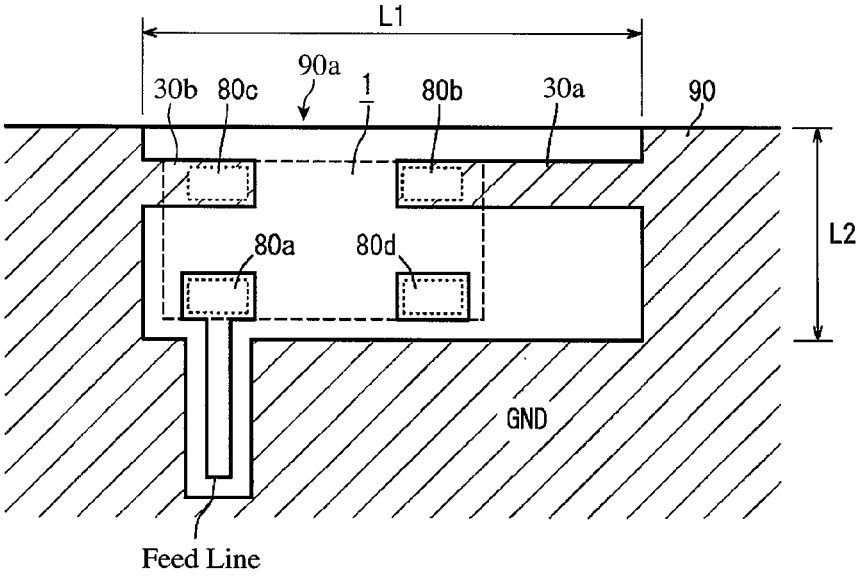
FIG. 18 is a plan view showing a still further example of the positional relations between the terminal electrodes of the laminate and the ground electrode and the line electrodes on the board when the laminate is mounted on the board.
Figure 19:
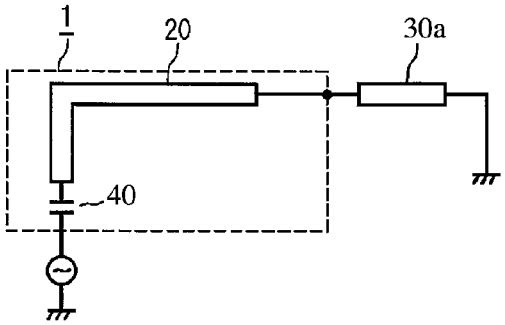
FIG. 19 is a view showing the equivalent circuit of an antenna corresponding to FIG. 18.

FIG. 18 shows a still further example of boards used in the present invention. In this example, a second terminal electrode 80*b* is connected to a first long line electrode 30*a* extending from a ground electrode GND formed on the board 90, and a third terminal electrode 80*c* is connected to a second short line electrode 30*b* extending from the ground electrode GND. When a small laminate 1 has a radiation electrode 20 whose effective length is insufficient to the operation wavelength, the first long line electrode 30*a* acts as a radiation electrode added to the radiation electrode 20, providing an equivalent circuit shown in FIG. 19. Because materials for the board 90 usually have smaller dielectric constants and larger quality coefficients Q than those of dielectric ceramics for the laminate 1, the use of the first line electrode 30*a* on the board 90 as an additional radiation electrode improves the gain, and makes phase adjustment easier.

Figure 20:
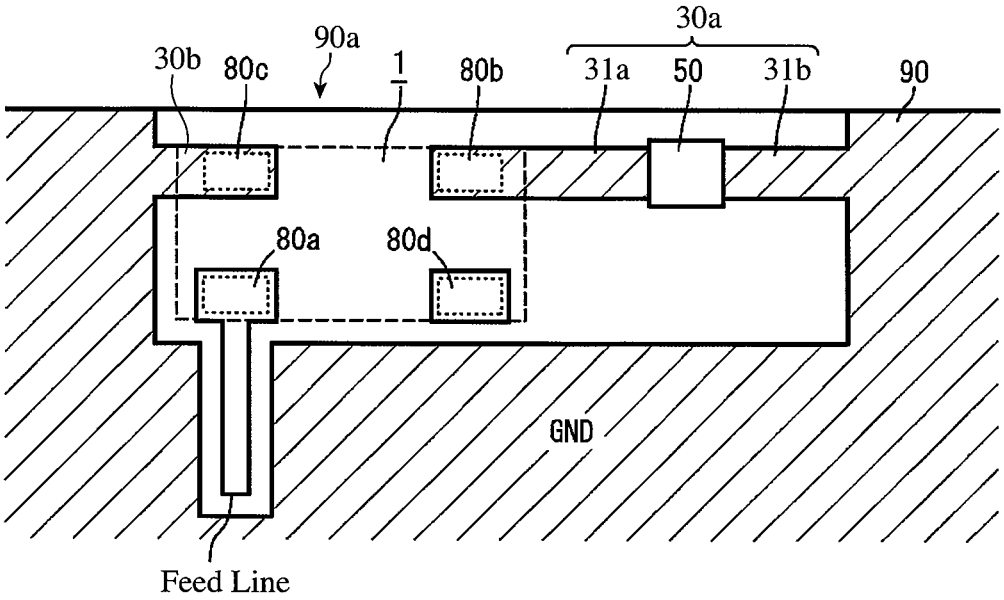
FIG. 20 is a plan view showing a still further example of the positional relations between the terminal electrodes of the board and the ground electrode and the line electrodes when the laminate is mounted on the board laminate.
Figure 21:
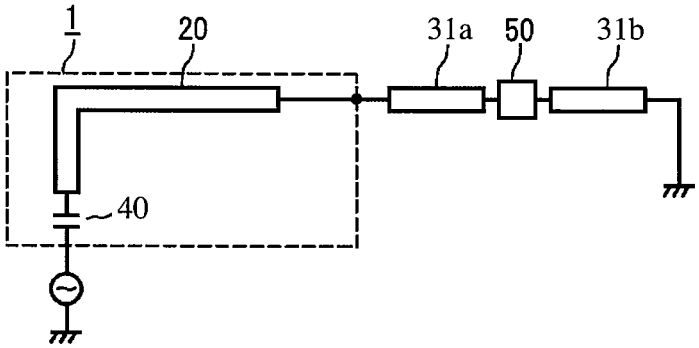
FIG. 21 is a view showing the equivalent circuit of an antenna corresponding to FIG. 20.

FIG. 20 shows a still further example of boards used in the present invention. In this example, a reactance element 50 is added to a first line electrode 30*a* connected to the second terminal electrode 80*b*, providing an equivalent circuit shown in FIG. 21. When the radiation electrode 20 has an effective length insufficient for the operation wavelength, the reactance element 50 can adjust the phase, improving the gain.

Though dielectric ceramics for the laminate 1 can be properly selected for the target frequency taking into consideration temperature characteristics, loss, etc., dielectric ceramics having dielectric constants $\in_r$ of about 5-200 (for example, alumina having $\in_r$ of about 10, calcium titanate and magnesium titanate having $\in_r$ of 40 or less, and barium titanate having $\in_r$ of 200 or less) are preferable to obtain sufficient gain even if the laminate 1 is small. Dielectric layers can be formed by a doctor blade method, etc.

The radiation electrode 20, the coupling electrode 10 and the first to fourth terminal electrodes 80*a*-80*d* as thick as several micronmeters to 20 μm can be formed by printing a conductive paste such as a silver paste, etc. on a dielectric ceramic by a screen-printing method, etc., and integrally sintering them. The conductors may be, in addition to silver, gold, copper, palladium, platinum, silver-palladium alloy, silver-platinum alloy, etc.

The present invention will be explained in more detail referring to Examples below without intention of restriction.

EXAMPLE 1

Using a dielectric Al—Si—Sr ceramic having a dielectric constant $\in_r$ of 8, a laminate for a Bluetooth/WLAN antenna used in a frequency band of 2.4-2.5 GHz, which had the basic structure shown in FIG. 9, was produced by the following method. First, $Al_2O_3$ powder, $SiO_2$ powder, $SrCO_3$ powder, $TiO_2$ powder, $Bi_2O_3$ powder, $Na_2CO_3$ powder and $K_2CO_3$ powder were uniformly wet-mixed by a ball mill, to have a post-sintering composition comprising 100% by mass of main components comprising 50% by mass of $Al_2O_3$, 36% by mass of $SiO_2$, 10% by mass of SrO, and sub-components comprising 4% by mass of $TiO_2$ 2.5% by mass of $Bi_2O_3$, 2% by mass of $Na_2O$ and 0.5% by mass of $K_2O$. The resultant mixture was calcined, pulverized, granulated, and then molded to ceramic green sheets having various thicknesses by a doctor blade method.

Each ceramic green sheet was screen-printed with a silver paste in an electrode pattern, laminated to have the structure shown in FIG. 9, and sintered at 820° C. to produce a mother substrate. The main radiation electrode portion 21 was constituted by a strip electrode of 5 μm in thickness, 0.3 mm in width and 3.5 mm in length, the sub-radiation electrode portion 22 was constituted by a strip electrode of 5 μm in thickness, 0.3 mm in width and 1.5 mm in length, and the coupling electrode 10 was constituted by a strip electrode of 5 μm in thickness, 0.3 mm in width and 1.5 mm in length.

A dielectric layer L1 was disposed between the upper surface and the main radiation electrode portion 21 in the laminate 1 such that their distance was 50 μm, and a 100-μm-thick dielectric layer L2 and a 100-μm-thick dielectric layer (not shown) having only via-holes 90 were disposed between the main radiation electrode portion 21 and the sub-radiation electrode portion 22 such that their distance was 200 μm. A 100-μm-thick dielectric layer L3 and a 100-μm-thick dielectric layer (not shown) having only via-holes 90 were disposed between the sub-radiation electrode portion 22 and the coupling electrode 10, such that their gap was 200 μm. A region of 300 μm from the lower surface to the coupling electrode 10 was constituted by a dielectric layer L4 and pluralities of dielectric layers L5. Connecting via-holes had diameters of 100 μm. After a silver paste was printed to a lower surface of the mother substrate to form terminal electrode patterns and baked, the stacked mother substrates were cut to a predetermined size to obtain a laminate 1 having an external size of 3.2 mm×1.6 mm×0.7 mm. This laminate 1 was mounted on the board 90 (L=90 mm, W=45 mm, La=41 mm, Lb=41 mm, L1=8 mm, L2=4 mm, and the length of the line electrode 30=4.5 mm) shown in FIGS. 18 and 22, and soldered to produce an antenna.

Figure 23:
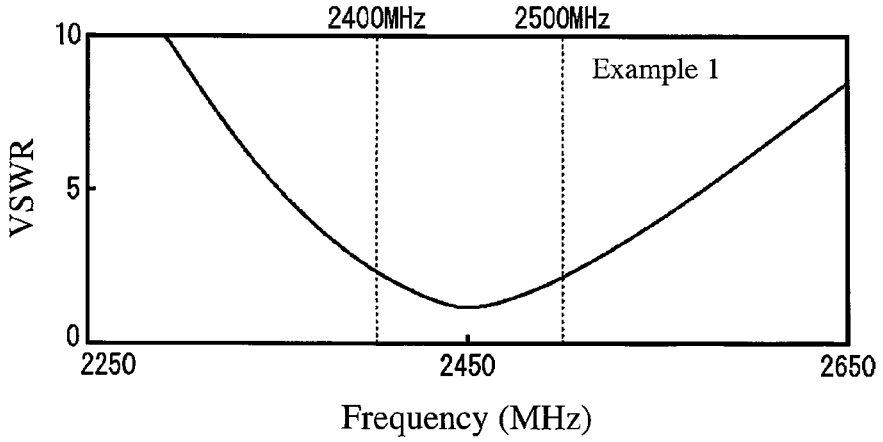
FIG. 23 is a graph showing the VSWR characteristics of the antenna of Example 1.
Figure 24:
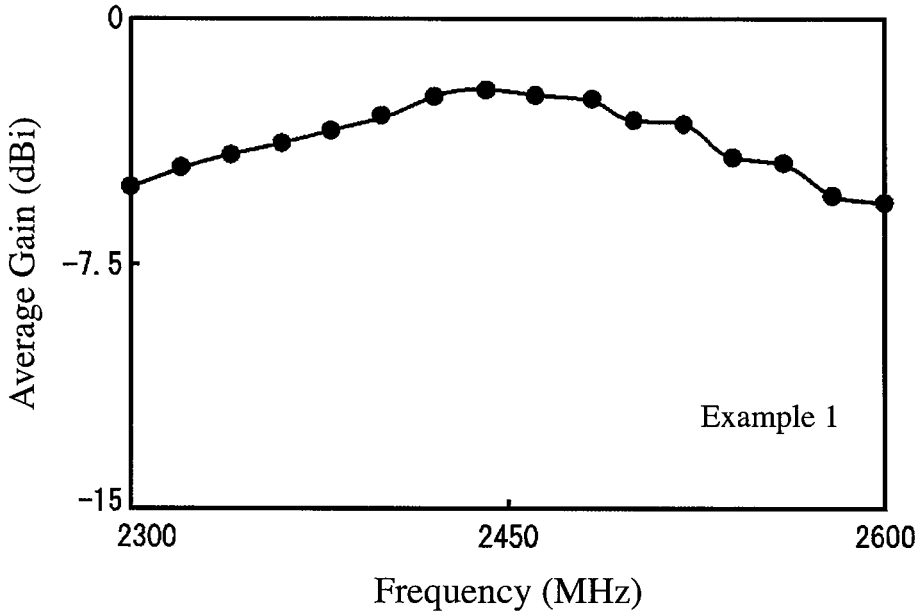
FIG. 24 is a graph showing the average gain characteristics of the antenna of Example 1.
Figure 25:
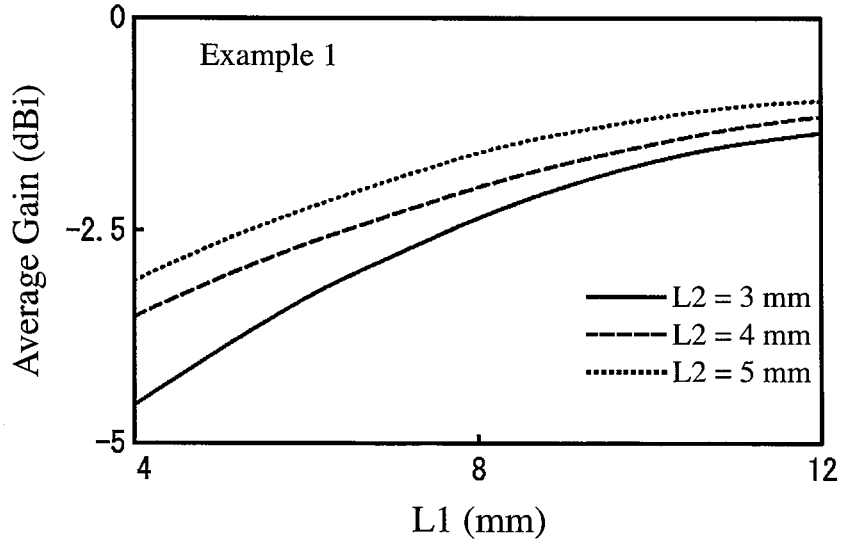
FIG. 25 is a graph showing the average gain characteristics of the antenna of Example 1 when L1 and L2 are changed.

This antenna was placed on a turntable rotating in a radio wave anechoic chamber. The antenna was connected to a port of a network analyzer with a coaxial cable, and transmission current was sent from the network analyzer to the antenna. Radio waves transmitted from a position as distant as 3 m were received by the antenna, to determine VSWR and average gain from the received power. As is clear from FIG. 23, this antenna had VSWR of 3 or less in a frequency band of 2.4-2.5 GHz. FIG. 24 shows the average gain (gains in an X-Y plan, a Z-X plan and a Y-Z plan were averaged) of this antenna. As is clear from FIG. 24, the average gain was −3.0 dBi or more in a frequency band of 2.4-2.5 GHz. FIG. 25 shows the change of the average gain when the L1 and L2 of the board 90 were changed. As is clear from FIG. 25, larger gaps L1 and L2 provided a larger average gain.

EXAMPLE 2

WLAN Antenna for 2.4-GHz Band and 5-GHz Band

Figure 26:
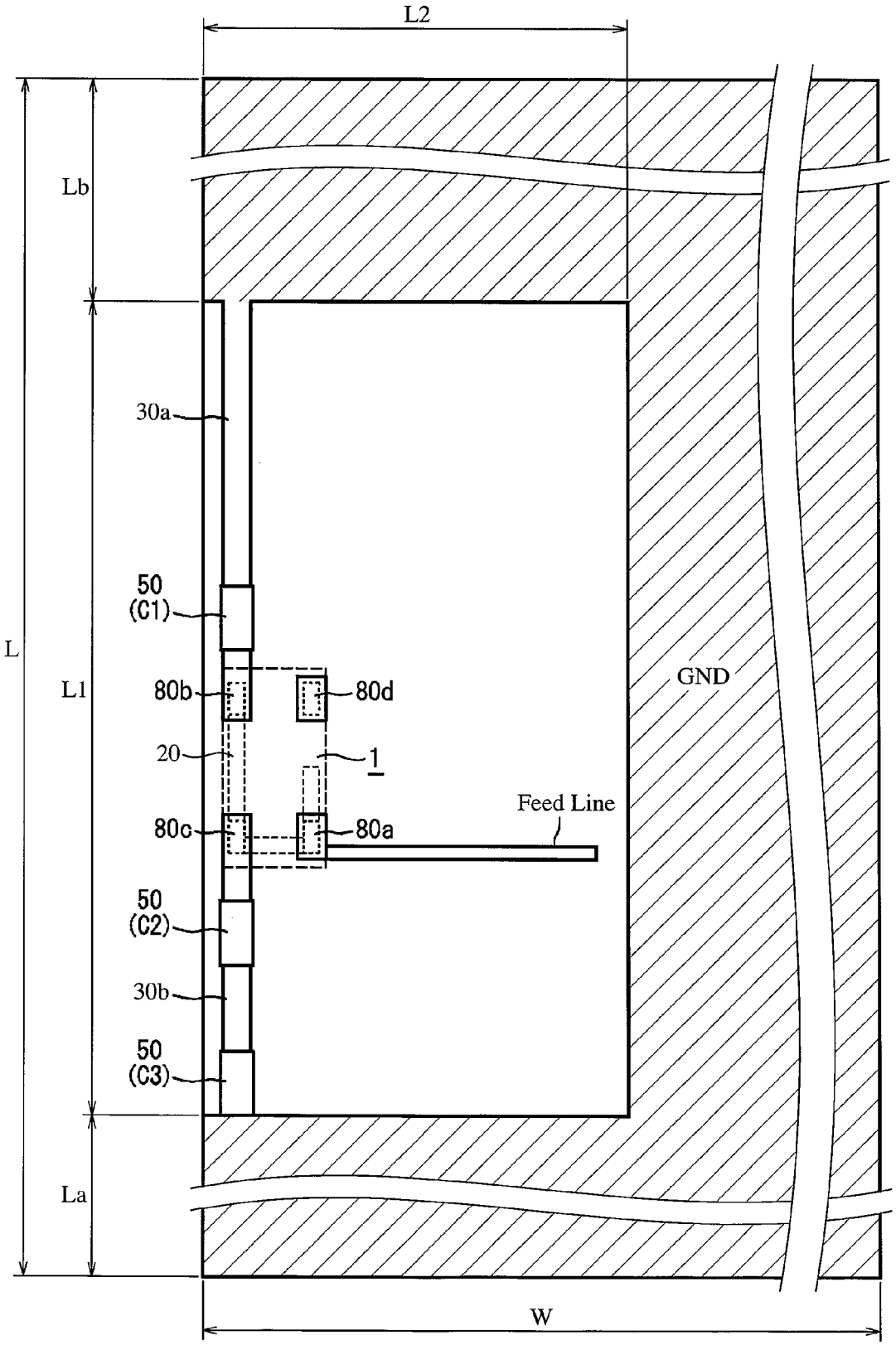
FIG. 26 is a plan view showing the positional relation between the terminal electrodes of the laminate and the ground electrode and the line electrodes on the board in the antenna of Example 2.

A laminate 1 having the same basic structure as in Example 1 was mounted by soldering on the board 90 (L=90 mm, W=45 mm, La=38.5 mm, Lb=38.5 mm, L1=13 mm, and L2=6 mm) shown in FIG. 26. Formed on the board 90 were a 6-mm-long first line electrode 30*a* connected to the second terminal electrode 80*b* of the laminate 1, and a 4-mm-long second line electrode 30*b* connected to the third terminal electrode 80*c* of the laminate 1. The first line electrode 30*a* was provided with a chip capacitor C1 (1.0 pF) as a reactance element 50. Thus, the first line electrode 30*a* constituted an additional radiation electrode, making the antenna usable in a 2.4-GHz band.

The second line electrode 30*b* soldered to a third terminal electrode 80*c* not connected to the radiation electrode 20 of the laminate 1 was connected to a feed line via capacitance between the first terminal electrode 80*a* and the third terminal electrode 80*c* and capacitance between the radiation electrode 20 and the third terminal electrode 80*c*. Added as reactance elements 50 to an intermediate portion of the second line electrode 30*b* were chip capacitors C2 (0.3 pF) and C3 (0.3 pF). Thus, the second line electrode 30*b* constituted an additional radiation electrode, making the antenna usable in a 5-GHz band. Instead of adding two capacitance-adjusting reactance elements 50 to the second line electrode 30*b*, one chip capacitor having proper capacitance may be added.

Figure 27A:
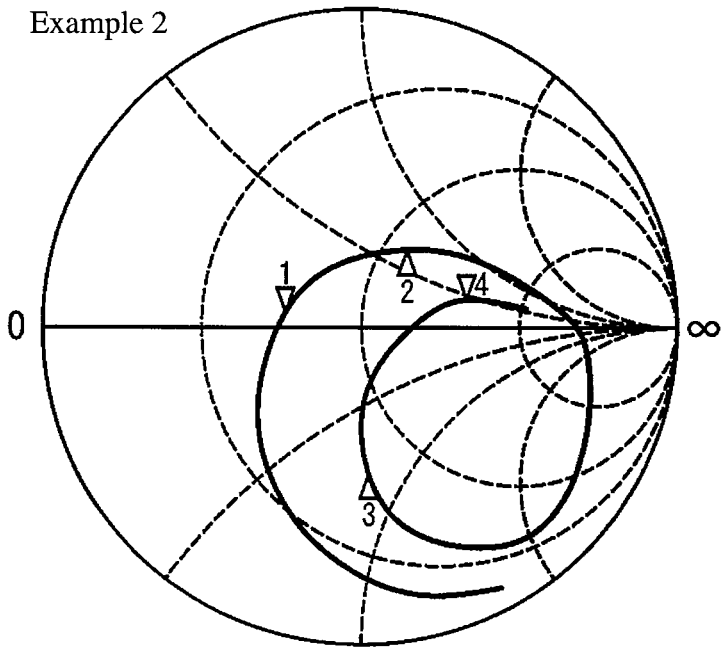
FIG. 27(*a*) is a Smith chart showing the impedance characteristics of the antenna of Example 2.
Figure 27B:
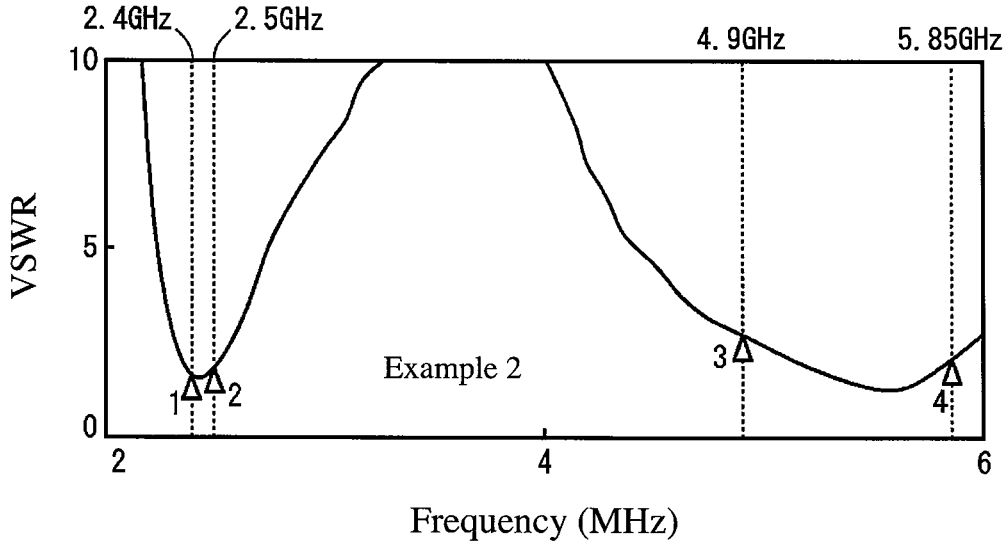

The characteristics of the antenna were evaluated by the same method as in Example 1 in a radio wave anechoic chamber. FIG. 27(*a*) is a Smith chart showing the impedance characteristics of the antenna, and FIG. 27(*b*) shows the VSWR characteristics of the antenna. As is clear from FIG. 27(*b*), VSWR of 3 or less was obtained in 2.4 GHz and 5 GHz.

EXAMPLE 3

GPS/WLAN Antenna for 1.5-GHz Band and 2.4-GHz Band

Figure 28:
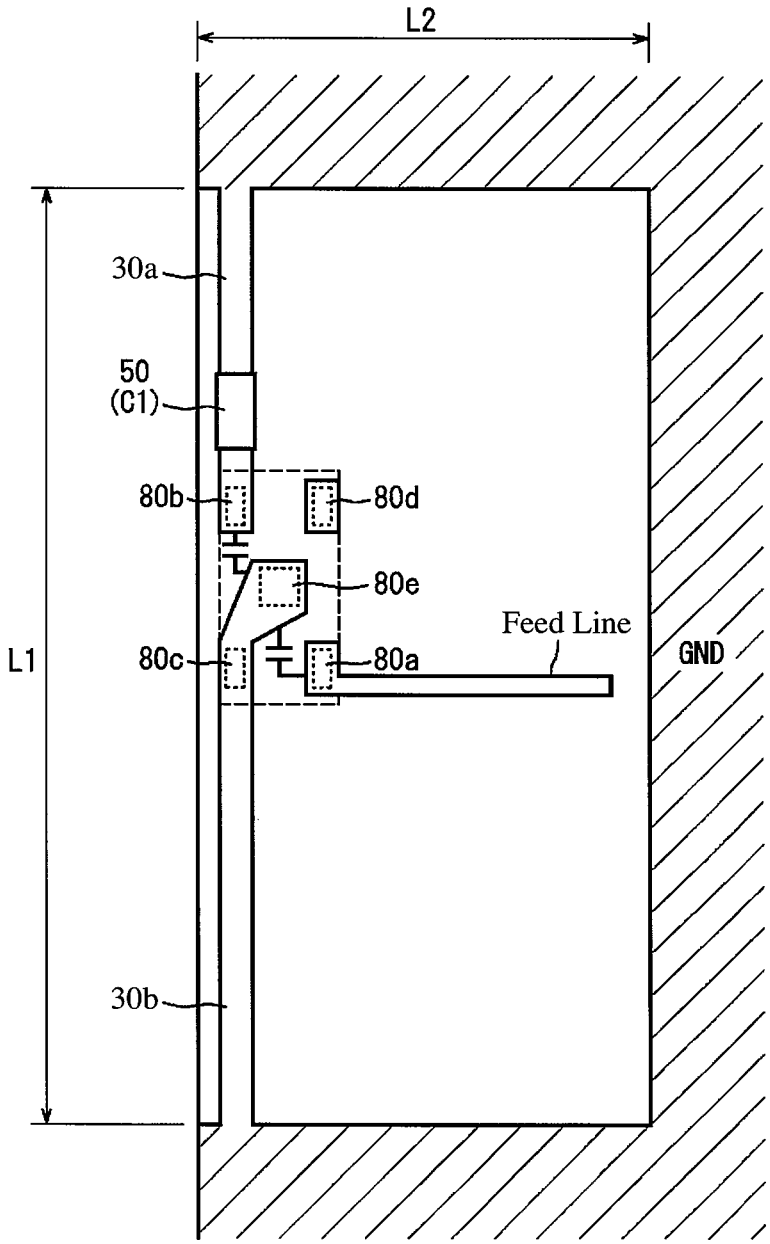
FIG. 28 is a plan view showing the positional relation between the terminal electrodes of the laminate and the ground electrode and the line electrodes on the board in the antenna of Example 3.

A laminate 1 having the same basic structure as in Example 1, in which a sub-radiation electrode portion 22 was as long as 2.5 mm, a coupling electrode 10 was as long as 2.5 mm, and gap between the sub-radiation electrode portion 22*b* and the coupling electrode 10 was 100 μm, was mounted on the board 90 shown in FIG. 28 by soldering. Formed on the board 90 were a first line electrode 30*a* connected to the second terminal electrode 80*b* of the laminate 1 and a second line electrode 30*b* connected to the third terminal electrode 80*c* of the laminate 1. The board 90 had the same L, W, La, Lb, L1, L2, and lengths of the line electrode 30 and the second line electrode 30*b* as in Example 2.

The first line electrode 30*a* soldered to the second terminal electrode 80*b* connected to the radiation electrode 20 of the laminate 1 was provided with a chip capacitor C1 (10 pF) as a reactance element 50. Thus, the first line electrode 30*a* constituted an additional radiation electrode, making the antenna usable in a 2.4-GHz band. The second line electrode 30*b* soldered to a third terminal electrode 80*c* not connected to the radiation electrode 20 of the laminate 1 was connected to a feed line via capacitance between the first terminal electrode 80*a* and the third terminal electrode 80*c* and capacitance between the radiation electrode 20 and the third terminal electrode 80*c* in the laminate 1. Thus, the second line electrode 30*b* constituted an additional radiation electrode, making the antenna usable in a 1.5-GHz band.

The second line electrode 30*b* extended to the fifth terminal electrode 80*e* at a center of the lower surface of the laminate 1 to have larger capacitance coupling to the first terminal electrode 80*a*. Capacitance was also formed between the second line electrode 30*b* and the second terminal electrode 80*b*, providing a path to the first line electrode 30*a* without passing through the radiation electrode 20 of the laminate 1. This structure expanded a frequency band in a 2.4-GHz band.

Figure 29A:
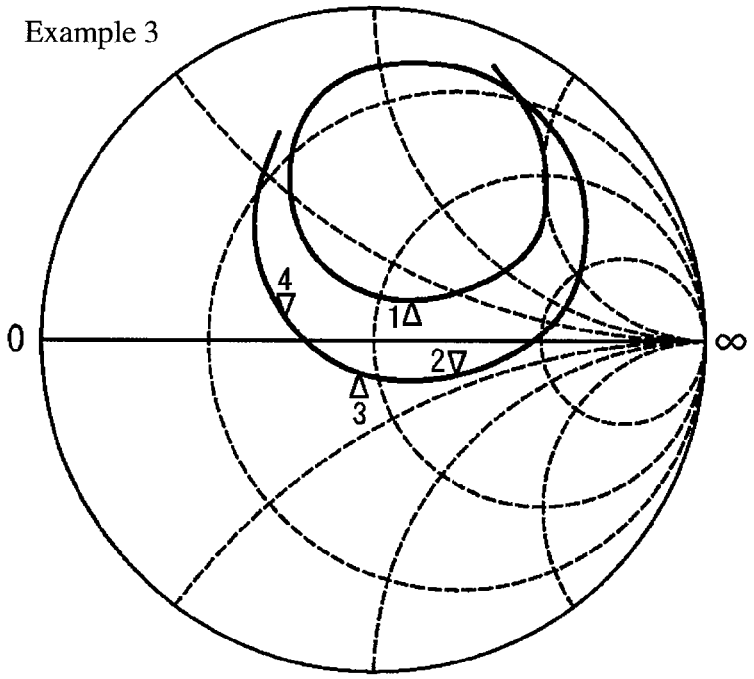
FIG. 29(*a*) is a Smith chart showing the impedance characteristics of the antenna of Example 3.
Figure 29B:
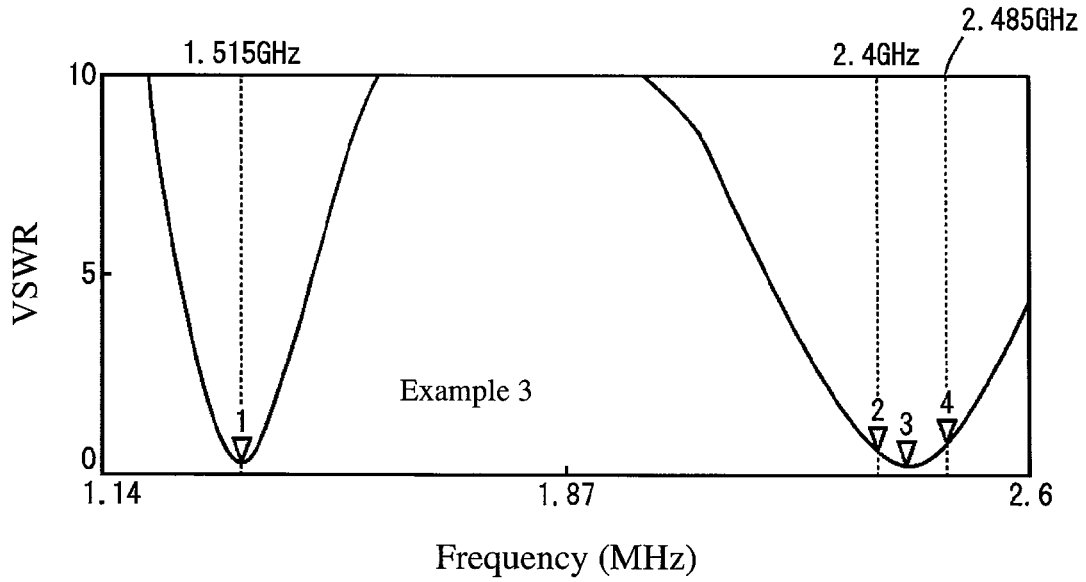

The characteristics of an antenna obtained by mounting the laminate 1 to this board 90 by soldering were evaluated by the same method as in Example 1 in a radio wave anechoic chamber. FIG. 29(*a*) is a Smith chart showing the impedance characteristics of the antenna, and FIG. 29(*b*) shows the VSWR characteristics of the antenna. As is clear from FIG. 29(*b*), VSWR of 3 or less was obtained in 1.5 GHz and 2.4 GHz.

EXAMPLES 4 AND 5

GPS Antenna for 1.5-GHz Band

Figure 5:
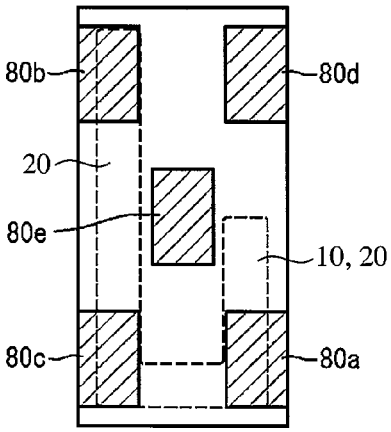
FIG. 5 is a view showing the positional relation between the terminal electrodes shown in FIG. 4 and the radiation electrode and the coupling electrode.
Figure 30:
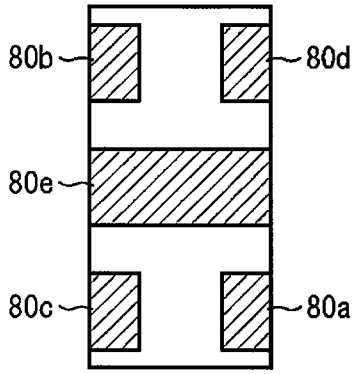
FIG. 30 is a view showing from above the terminal electrodes of the laminate in Example 5.
Figure 31:
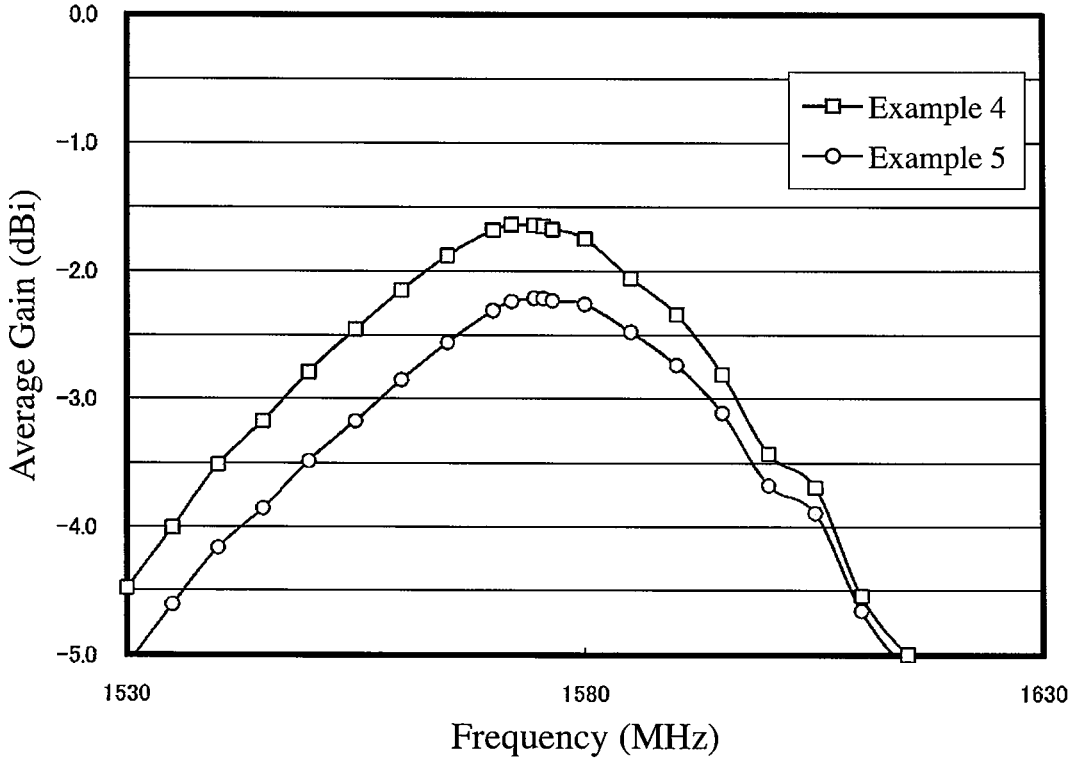
FIG. 31 is a graph showing the average gain characteristics of the antennas of Examples 4 and 5.
Figure 32:
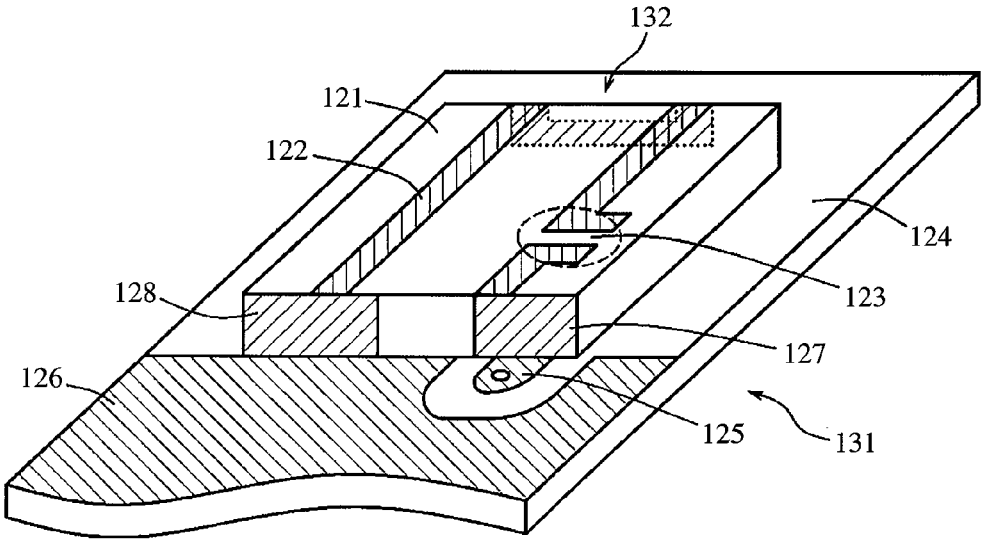
FIG. 32 is a perspective view showing the appearance of a conventional antenna.

Example 4 used a laminate 1 having the same basic structure as in Example 3 except for comprising a fifth terminal electrode 80*e* in a center portion of the lower surface such that the fifth terminal electrode 80*e* did not overlap the radiation electrode 20 and the coupling electrode 10 in a lamination direction as shown in FIG. 5, and Example 5 used a laminate 1 having the same basic structure as in Example 3 except that the fifth terminal electrode 80*e* was large enough to overlap the radiation electrode 20 and the coupling electrode 10 in a lamination direction as shown in FIG. 30. Each laminate 1 was mounted on the same board 90 as in Example 3 by soldering to produce an antenna, whose average gain was measured in a 1.5-GHz band by the same method as in Example 1 in a radio wave anechoic chamber. FIG. 31 shows the frequency characteristics of the average gains. The antenna of Example 4 in which the fifth terminal electrode 80*e* did not overlap the radiation electrode 20 had a larger average gain by 0.5 dBi or more than that of the antenna of Example 5 in which the fifth terminal electrode 80*e* overlapped the radiation electrode 20. Incidentally, an antenna comprising a laminate having no fifth terminal electrode 80*e* had a gain on the same level as in Example 4.

What is claimed is:

1. An antenna comprising a laminate of dielectric ceramic layers each provided with electrode patterns, said laminate comprising a first terminal electrode connected to a feed line, a second terminal electrode for grounding and a third terminal electrode for grounding on the lower surface, a radiation electrode on the upper surface or on a layer near the upper surface, and a coupling electrode between said lower surface and said radiation electrode;

said coupling electrode being connected to the first terminal electrode through via-holes;

said radiation electrode having one end as an open end and the other end connected to the second terminal electrode through via-holes, said radiation electrode overlapping said third terminal electrode in a lamination direction via said dielectric ceramic layers; and said coupling electrode being partially opposite to said radiation electrode in a lamination direction to form a capacitance-coupling portion.

2. The antenna according to claim 1, wherein said radiation electrode is constituted by pluralities of electrode portions, an electrode portion opposite to said coupling electrode and other electrode portions being formed on different layers.

3. The antenna according to claim 1, wherein said third terminal electrode constitutes capacitance with said first terminal electrode.

4. The antenna according to claim 3, wherein said laminate comprises a fifth terminal electrode in a substantially center portion of the lower surface.

5. The antenna according to claim 4, wherein said fifth terminal electrode does not overlap said radiation electrode and said coupling electrode in a lamination direction.

6. The antenna according to claim 1, wherein said third terminal electrode is connected to said first terminal electrode.

7. The antenna according to claim 1, which comprises a board on which said laminate is mounted, said board being provided with a ground electrode having first and second line electrodes, a second terminal electrode connected to said ground electrode via said first line electrode, and said third terminal electrode being connected to said ground electrode via said second line electrode.

8. The antenna according to claim 7, wherein at least said first line electrode is provided with a reactance element.

* * * * *